US008950187B2

(12) United States Patent
Pasqualotto et al.

(10) Patent No.: US 8,950,187 B2
(45) Date of Patent: Feb. 10, 2015

(54) PREMIX BURNER OF THE MULTI-CONE TYPE FOR A GAS TURBINE

(71) Applicant: ALSTOM Technology Ltd, Baden (CH)

(72) Inventors: Ennio Pasqualotto, Winterthur (CH); Hanspeter Knopfel, Dottikon (CH)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 13/937,538

(22) Filed: Jul. 9, 2013

(65) Prior Publication Data

US 2014/0013760 A1 Jan. 16, 2014

(30) Foreign Application Priority Data

Jul. 10, 2012 (EP) ..... 12175641

(51) Int. Cl.
*F02C 1/00* (2006.01)
*F23R 3/28* (2006.01)
*F23C 7/00* (2006.01)

(52) U.S. Cl.
CPC ..... *F23R 3/286* (2013.01); *F23C 7/002* (2013.01); *F23C 2900/07002* (2013.01)
USPC ..... 60/737; 60/748

(58) Field of Classification Search
CPC . F23C 2900/07002; F23C 7/002; F23R 3/286
USPC ..... 60/737, 748, 752; 431/181, 182, 187, 431/188, 350, 354; 239/399, 402, 403, 405
See application file for complete search history.

(56) References Cited

U.S. PATENT DOCUMENTS

| | | | | | |
|---|---|---|---|---|---|
| 4,781,030 | A | * | 11/1988 | Hellat et al. | 60/743 |
| 5,375,995 | A | * | 12/1994 | Dobbeling et al. | 431/8 |
| 5,735,687 | A | * | 4/1998 | Knopfel et al. | 431/354 |
| 5,738,508 | A | * | 4/1998 | Dobbeling et al. | 431/350 |
| 5,738,509 | A | * | 4/1998 | Marling et al. | 431/352 |
| 5,954,496 | A | * | 9/1999 | Dobbeling et al. | 431/354 |
| 5,980,240 | A | * | 11/1999 | Krautzig et al. | 431/285 |
| 5,984,670 | A | * | 11/1999 | McMillan et al. | 431/350 |
| 6,019,596 | A | * | 2/2000 | Knopfel et al. | 431/350 |
| 6,155,820 | A | * | 12/2000 | Dobbeling et al. | 431/350 |
| 6,702,574 | B1 | * | 3/2004 | Dobbeling | 431/350 |
| 7,632,091 | B2 | * | 12/2009 | Steinbach et al. | 431/350 |
| 7,913,494 | B2 | * | 3/2011 | Hiromitsu et al. | 60/748 |
| 2004/0226297 | A1 | * | 11/2004 | Griffin et al. | 60/737 |
| 2007/0042307 | A1 | | 2/2007 | DeMarcos et al. | |

(Continued)

FOREIGN PATENT DOCUMENTS

| | | |
|---|---|---|
| DE | 195 45 310 | 6/1997 |
| EP | 0 851 172 | 7/1996 |

(Continued)

*Primary Examiner* — Gerald L Sung

(57) ABSTRACT

A premix burner of the multi-cone type for a gas turbine, that includes a plurality of shells, which are arranged around a central burner axis and are parts of a virtual, axially extending common cone, which opens in a downstream direction, whereby the parts are displaced perpendicular to the burner axis such that a tangential slot is defined between each pair of adjacent shells. A disadvantageous transition piece between the shells and a downstream mixing tube is avoided by bordering the downstream ends of the shells by intersecting planes, which are defined by intersecting the shells with a virtual coaxial cylinder of a predetermined radius.

3 Claims, 1 Drawing Sheet

(56) References Cited

U.S. PATENT DOCUMENTS

| | | | | |
|---|---|---|---|---|
| 2008/0115497 | A1* | 5/2008 | Eroglu et al. | 60/737 |
| 2010/0175381 | A1* | 7/2010 | Wilbraham | 60/737 |

FOREIGN PATENT DOCUMENTS

| | | |
|---|---|---|
| EP | 2 423 597 | 2/2012 |
| WO | 2009/019113 | 2/2009 |

* cited by examiner

PREMIX BURNER OF THE MULTI-CONE TYPE FOR A GAS TURBINE

CROSS-REFERENCE TO RELATED APPLICATIONS

This application claims priority to EP Application 12175641.5 filed Jul. 10, 2012, the contents of which are hereby incorporated in its entirety.

TECHNICAL FIELD

The present invention relates to the technology of gas turbines. It refers to premix burner of the multi-cone type for a gas turbine according to the preamble of claim 1.

BACKGROUND

In the past more than 20 years burners with short but effective premixing zones (so-called EV burners: environmental friendly V-shaped burners) have been implemented in several gas turbines of the applicant, with very low NOx levels. In addition to this, three variants of premix technologies have been successfully developed and deployed into those gas turbine engines: the sequential EV burners—a technology that allows premixing of natural gas and oil into a hot exhaust stream to reheat the exhaust gases of a first high pressure turbine; the MBtu EV burners that are used to burn syngas in a premix flame with low NOx emissions; and the advanced EV burners (AEV) that are capable to prevaporize and premix liquid fuel prior to combustion and burn it with very low NOx emissions without water injection.

Document EP 0 851 172 A2 discloses an exemplary EV burner of the double-cone type, for operating a combustion chamber with a liquid and/or gaseous fuel, whereby the combustion air required for this purpose is directed through tangential air-inlet ducts into an interior space of the burner. This directing of the flow results in a swirl flow in the interior space, which swirl flow induces a backflow zone at the outlet of the burner. In order to stabilize the flame front forming there, at least one zone is provided at each sectional body forming the burner, within which zone inlet openings are provided for the injection of supplementary air into the swirl flow. Due to this injection, a film forms at the inner wall of the sectional bodies, which film prevents the flame from being able to flashback along the inner wall of the sectional bodies into the interior space of the burner.

Document EP 2 423 597 A2 shows another exemplary EV burner in the form of a double-cone burner, which has two partial cone shells which are arranged nested one inside the other, forming air inlet ducts between them, through which combustion air from the outside flows into a conical inner space of the premix burner. Linear rows of holes of injection openings, which extend transversely to the flow direction of the combustion air, are arranged on the outer walls of the air inlet ducts and through which a gaseous fuel is injected into the combustion air which flows past transversely to them.

Document DE 195 45 310 A1 discloses a further premixing burner consisting of a hollow cone with an outer and inner cone casing. At least two inlet ducts run at a tangent to the inner cone casing and are positioned along a straight cone casing line. The part cone axes of the part shells formed lie on the same cone axis. The pre-mixing burner is divided into at least two, for example four, parts containing the inlet ducts so as to swirl the combustion air. A fuel nozzle is positioned at the cone tip for injecting liquid fuel.

Document WO 2009/019113 A2 describes a burner, which includes a swirl generator, a mixer, and a lance. The swirl generator encloses an inlet-side section of a burner interior and has at least one air inlet which extends tangentially with regard to a longitudinal centre axis of the burner. The swirl generator is conically designed. The respective air inlet forms a longitudinal slot along the generated surface of the cone. A plurality of such air inlets are preferably arranged in a distributed manner in the circumferential direction. As a result of this, the air can penetrate tangentially into the burner interior, as a result of which a swirl is imparted to it. The swirl generator also has a fuel inlet via which gaseous fuel can be introduced into the burner interior. The fuel inlet includes a plurality of rows of individual inlet orifices which extend along the surface line of the conical swirl generator, through which orifices the fuel gas can enter the burner interior. The mixer encloses an outlet-side section of the burner interior and has an outlet opening which is open towards a combustion space of the combustion chamber. The mixer, includes a tubular body which is connected via a tubular transition piece to the swirl generator and carries an outlet flange with an outlet opening. Via the outlet flange, the burner can be connected to the combustion chamber. The mixer is expediently cylindrically formed.

In principle, to lower NOx formation, the fuel air mixing can be extended by applying a mixing tube at the exit of a burner prior to the sudden area expansion entering the combustion chamber where the flame is stabilized by the recirculating flow. The air slots and gas channels of the current EV type conical burners are confined in the downstream part by an intersecting plane orthogonal to the burner axis. Therefore the burner swirler exit is not circular and needs a special transition piece in-between the swirler and the cylindrical mixing tube. This transition piece is prone to flash-back as it must apply a complicated 3D shape to avoid flow separation and flame stabilization in recirculation zones.

Thus, when applying a mixing tube to further enhance fuel air mixing at the downstream part of the burners, the problem consists in defining a transition piece between the swirler and the mixing tube such that recirculation zones, which could lead to flash-back, are not formed.

SUMMARY

It is an object of the present invention to provide a premix burner of the multi-cone type, which avoids the drawbacks of the known burners and combines a simplified design with the ability to prohibit flash-backs.

This and other objects are obtained by a premix burner according to claim 1.

The premix burner of the multi-cone type for a gas turbine according to the invention comprises a plurality of shells, which are arranged around a central burner axis and are parts of a virtual, axially extending common cone, which opens in a downstream direction, whereby said parts are displaced perpendicular to said burner axis such that a tangential slot is defined between each pair of adjacent shells.

It is characterized in that the downstream ends of the shells are bordered by intersecting planes, which are defined by intersecting said shells with a virtual coaxial cylinder of a predetermined radius.

According to an embodiment of the invention each of the shells is equipped with a premix gas channel extending along an axially oriented edge of the respective shell such that a gas can be injected from said premix gas channel through gas injection holes into a stream of air entering the interior of the arrangement of shells through the adjacent slot, and that the downstream ends of the premix gas channels are bordered by intersecting planes, which are defined by intersecting said premix gas channels with said virtual coaxial cylinder of said predetermined radius.

According to another embodiment of the invention a cylindrical burner ring with an inner radius similar to said predetermined radius is attached to the arrangement of shells, and premix gas channels, respectively, in the area of the intersecting planes.

Specifically, said premix burner with the attached burner ring is mounted within a coaxial burner sleeve to be slideable in axial direction.

More specifically, said burner sleeve is mounted with its downstream end in a front panel of a combustion chamber.

BRIEF DESCRIPTION OF THE DRAWINGS

The present invention is now to be explained more closely by means of different embodiments and with reference to the attached drawings.

DETAILED DESCRIPTION

In the known AEV Burner design concept a transition piece is needed in order to adapt the sickle shaped cross section at the swirler exit to the cylindrical cross section of the mixing tube (see for example document WO 2009/019113 A2 cited above). This transition piece needs careful aerodynamic layout in order to avoid flow separation and consequential flashback.

The present invention avoids the need for a transition piece. The downstream end of the cone shells is formed such that they are cutting in the cylindrical shape of a burner ring, which is an integral part of the extractable burner. The embodiment shown in FIGS. 1 and 2 shows the basic principle of the solution.

Figure 1:
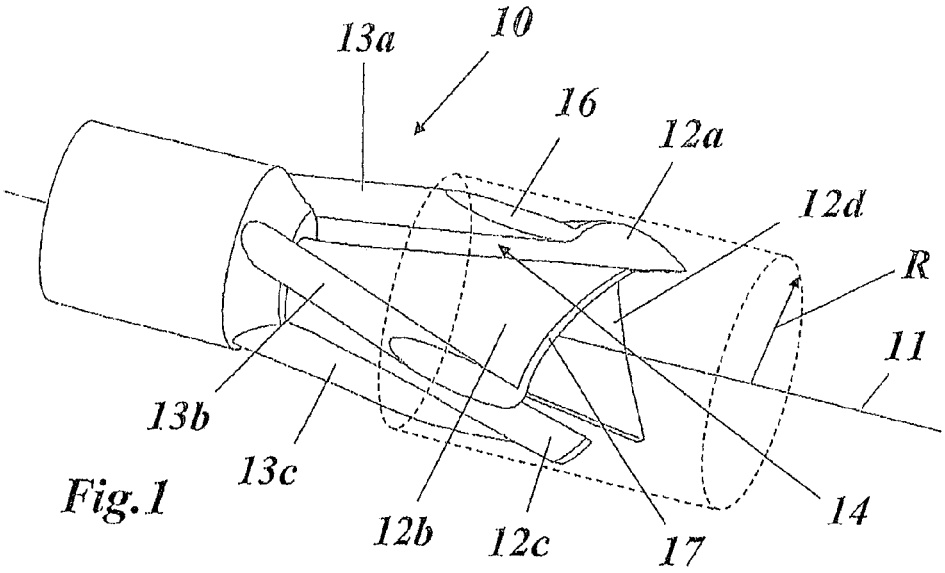
FIG. 1 shows in a perspective view a premix burner according to an embodiment of the invention.
Figure 2:
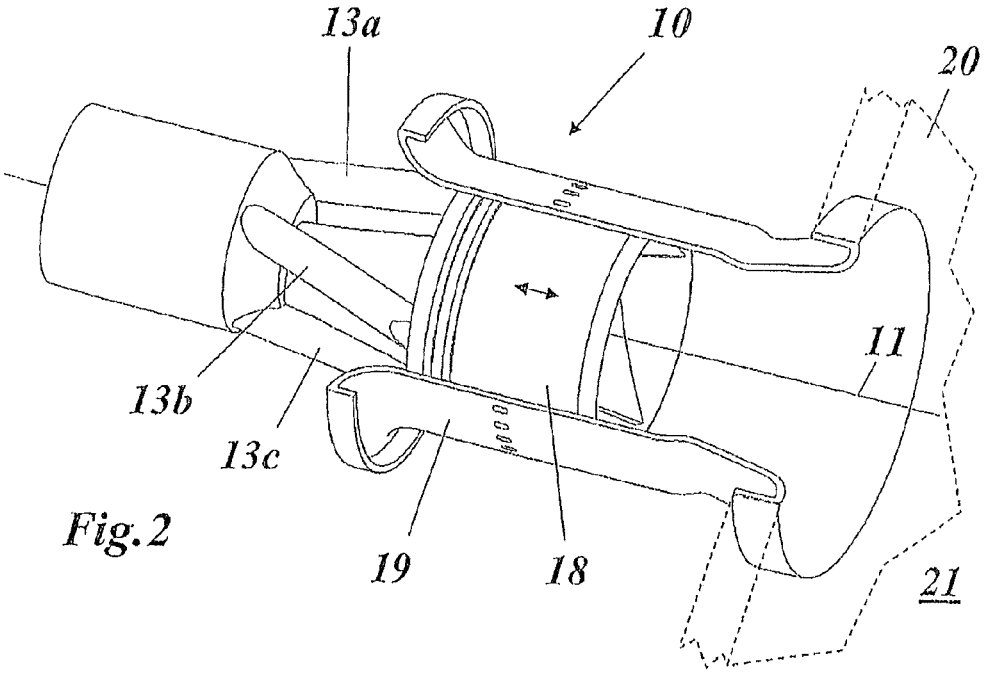
FIG. 2 shows the premix burner of FIG. 1 with the additional burner ring surrounding the swirler arrangement, and being moveably mounted in a burner sleeve.

The premix burner 10 of FIG. 1 extends along a central burner axis 11. It comprises four identical shells 12*a-d*, which are parts of a virtual cone, which opens into the downstream direction (running from left to right in the Figures). The shells are displaced form their original position in said virtual cone perpendicular to the burner axis to define a tangential slot 14 between each pair of adjacent shells. Through theses slots 14 air enters into the interior of the conical shell arrangement in a swirling fashion. At each slot 14, a premix gas channel 13*a-c*, which runs along an axial edge of an adjacent shell, is provided to inject a gaseous fuel through holes (not shown) into the entering air stream.

Now, the burner shells 12*a-d* are extended and intersected naturally with a virtual coaxial cylinder with a predetermined Radius R (shown with dashed lines in FIG. 1), which is adapted to the cylindrical shape of the subsequent mixing tube, thereby avoiding the need of a special transition piece. By means of this intersection, the downstream ends of the shells 12*a-d* and the downstream ends of the premix gas channels 13*a-c* are bordered by cylindrical intersecting planes 16 and 17, which make it possible to slide a cylindrical burner ring 18 onto the shell arrangement (FIG. 2) in order to fix the downstream ends of the shells 12*a-d*.

The premix burner 10 with the attached burner ring 18 can then be introduced into an essentially cylindrical coaxial burner sleeve 19, which is mounted with its downstream end in a front panel 20 of a combustion chamber 21. The premix burner 10 with the attached burner ring 18 can be moved in axial direction to adjust it relative to the combustion chamber 21 or other burners working in parallel (see the double arrow in FIG. 2). Furthermore, sealing means may be provided between the burner ring 18 and the burner sleeve 19, as well as holes for introducing purging air into the gap between the burner ring 18 and the burner sleeve 19.

What is claimed is:

1. A premix burner of a multi-cone type for a gas turbine, said premix burner comprising:

a plurality of shells which are arranged around a central burner axis and are sections of a virtual, axially extending common cone, which opens in a downstream direction, wherein the plurality of shells are displaced perpendicular to said burner axis such that a tangential slot is defined between each pair of adjacent shells, and wherein downstream ends of the shells are bordered by intersecting planes, which are defined by intersecting said shells with a virtual coaxial cylinder of a predetermined radius; and a cylindrical burner ring with an inner radius similar to said predetermined radius, the downstream ends of the shells are directly attached to an inner surface of the cylindrical burner ring, said premix burner with the attached burner ring is mounted within a coaxial burner sleeve, and the cylindrical burner ring is slideable in the axial direction of the premix burner.

2. The premix burner according to claim 1, wherein each of the shells is equipped with a premix gas channel extending along an axially oriented edge of the respective shell such that a gas can be injected from said premix gas channel through gas injection holes into a stream of air entering the interior of the arrangement of shells through an adjacent tangential slot, and the downstream ends of the premix gas channels are bordered by intersecting planes, which are defined by intersecting said premix gas channels with said virtual coaxial cylinder of said predetermined radius.

3. The premix burner according to claim 1, wherein said burner sleeve is mounted with its downstream end located in a front panel of a combustion chamber.

* * * * *